US007185658B1

(12) United States Patent
Focke et al.

(10) Patent No.: US 7,185,658 B1
(45) Date of Patent: Mar. 6, 2007

(54) APPARATUS FOR PRODUCING AND/OR PACKAGING CIGARETTES

(75) Inventors: Heinz Focke; Martin Stiller, both of Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 795 days.

(21) Appl. No.: 09/598,995

(22) Filed: Jun. 21, 2000

(30) Foreign Application Priority Data

Jun. 21, 1999 (DE) ..... 199 28 360

(51) Int. Cl.
*A24C 1/04* (2006.01)

(52) U.S. Cl. ..... 131/96; 131/110; 131/282

(58) Field of Classification Search ..... 131/96, 131/110, 282
See application file for complete search history.

(56) References Cited

U.S. PATENT DOCUMENTS

| | | | | |
|---|---|---|---|---|
| 1,582,544 A | | 4/1926 | Rundell | |
| 3,955,584 A | | 5/1976 | Molins et al. | |
| 4,055,192 A | | 10/1977 | Berlin et al. | 131/84 |
| 4,503,967 A | | 3/1985 | Erdmann et al. | 198/419 |
| 5,806,531 A | * | 9/1998 | Diehl et al. | 131/110 |
| 6,067,992 A | * | 5/2000 | Spatafora | 131/84.4 |

FOREIGN PATENT DOCUMENTS

| | | |
|---|---|---|
| CN | 1145755 | 3/1997 |
| DE | 2152301 | 6/1972 |
| DE | 2433644 | 1/1975 |
| DE | 3812689 | 11/1989 |
| DE | 3819534 | 12/1989 |
| DE | 19518401 | 12/1996 |
| DE | 19630376 | 4/1998 |
| DE | 19719198 | 11/1998 |
| EP | 738477 | 10/1996 |

OTHER PUBLICATIONS

Office action of CN application No. CN20000118671, published as CN1278507, being a CN application corresponding to the present application, with the office action dated Jul. 23, 2004 (in Chinese with English translation).

TORTA Research S.r.l. publication of "Remarks concerning the patentability of European patent application 00112459.3", dated Dec. 2, 2002, being an EPO application published as EP1062833 and corresponding to the present application.

* cited by examiner

*Primary Examiner*—Dionne W. Mayes
(74) *Attorney, Agent, or Firm*—Abelman, Frayne & Schwab

(57) ABSTRACT

During the production of cigarettes, but in particular in the region of a cigarette-packaging machine, a comparatively large amount of tobacco accumulates as waste. This is specifically removed by arranging suction-extraction elements and/or conveying-away elements for tobacco particles (19) in the region of elements and subassemblies of the machines with increased accumulation of tobacco. The air with tobacco particles (19) which has been extracted by suction is led through a tobacco separator (45), which has a separating element (48) for receiving the tobacco particles. From time to time, these are removed from the tobacco separator (45) and recycled into the production process.

16 Claims, 4 Drawing Sheets

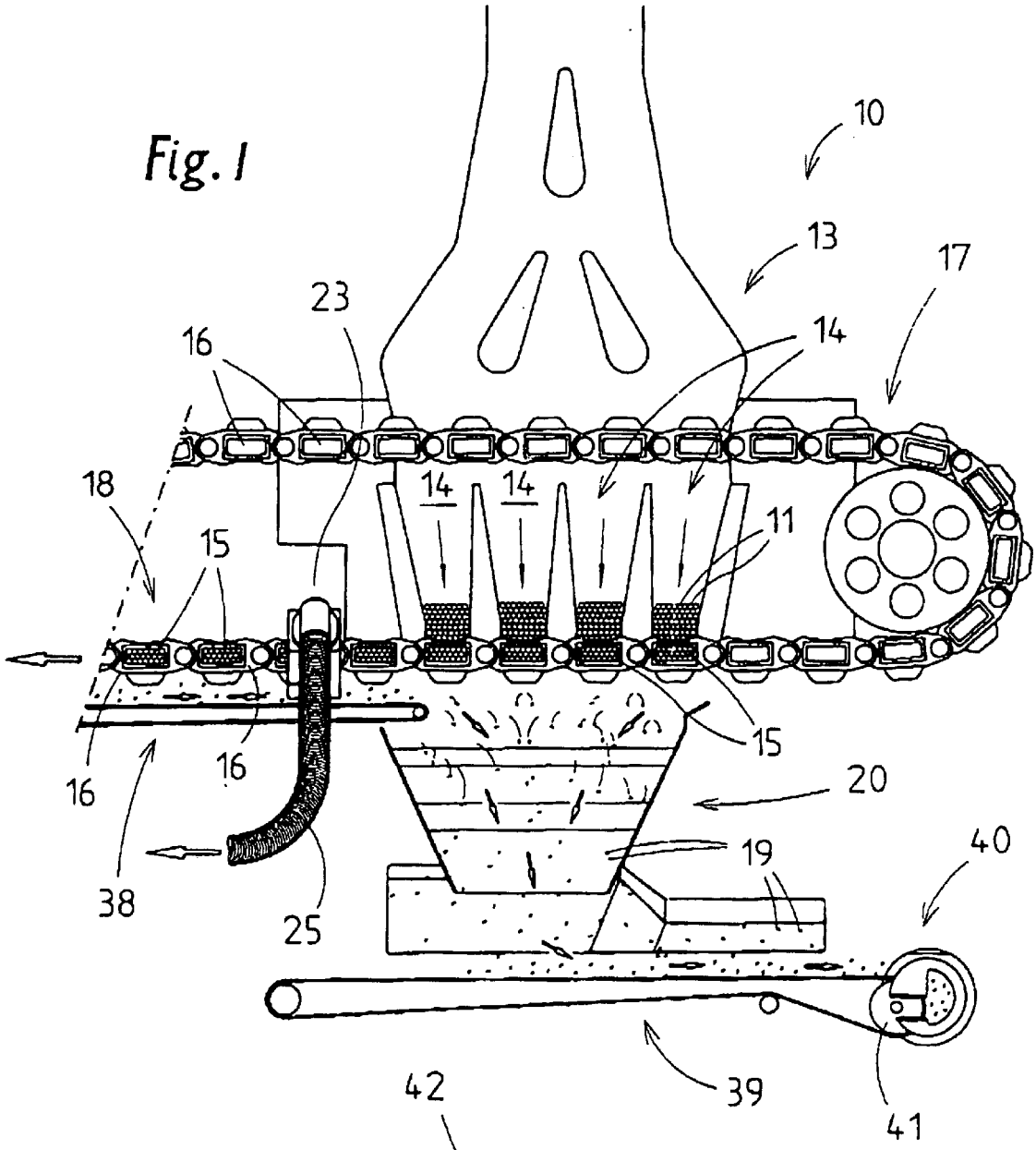
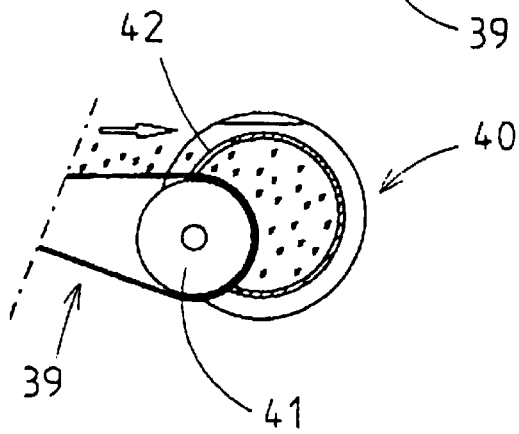
Fig. 2

Fig.3
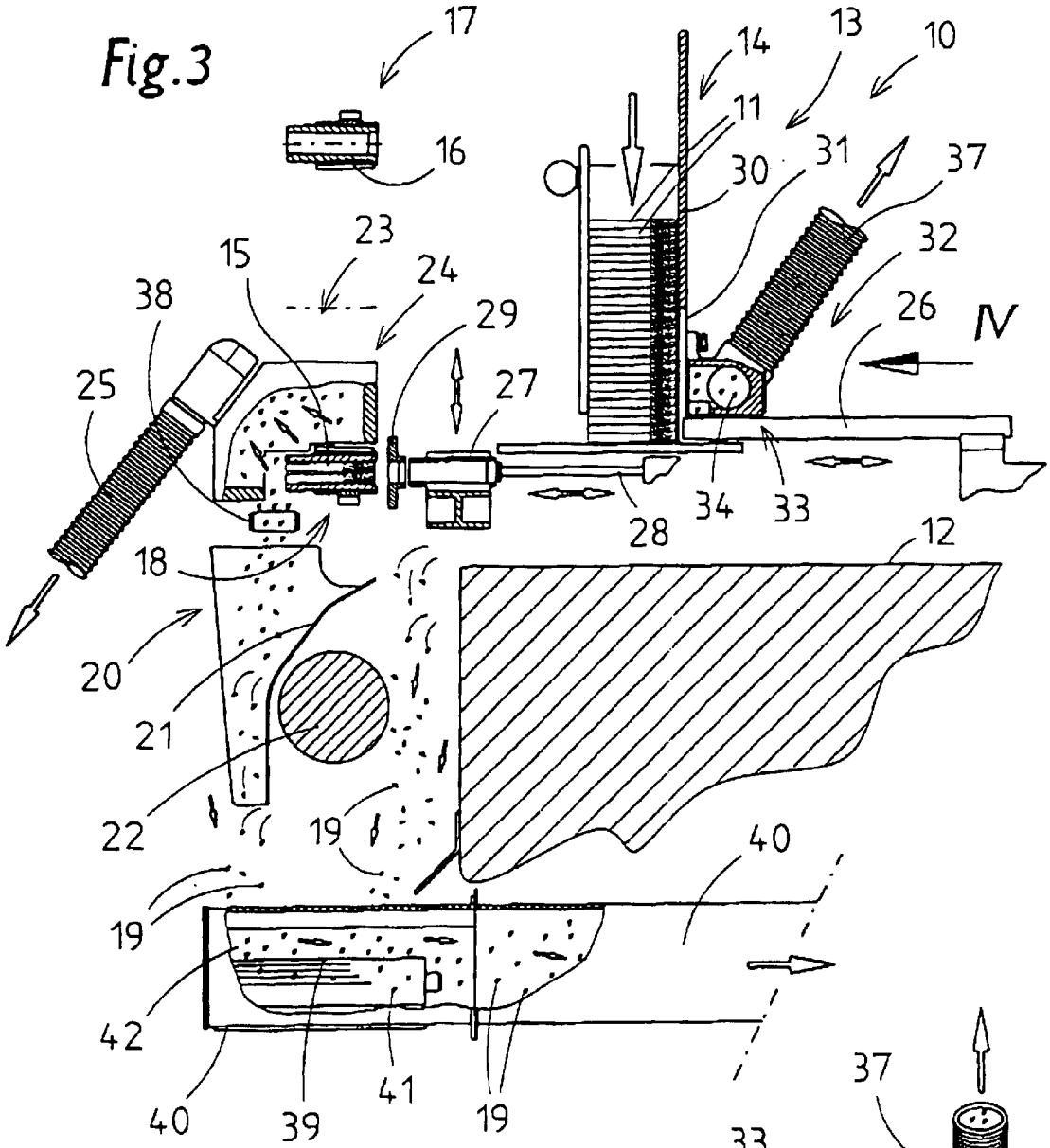
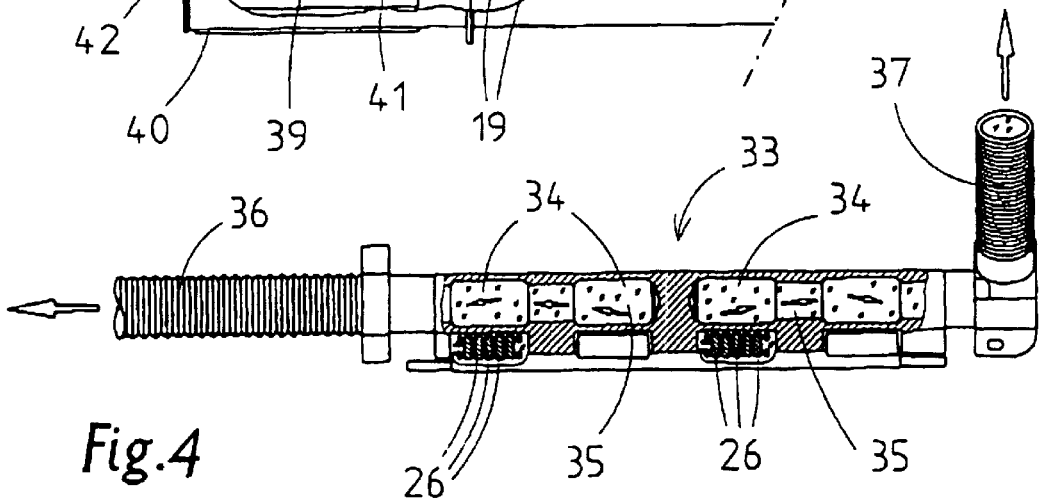
Fig.4

APPARATUS FOR PRODUCING AND/OR PACKAGING CIGARETTES

DESCRIPTION

The invention relates to a process for producing and/or packaging tobacco products, in particular cigarettes. The invention also relates to a cigarette-producing machine (maker) and a packaging machine for cigarettes (packer).

In the task of dealing with cut tobacco, in particular during the production and packaging of cigarettes, tobacco particles accumulate to a relatively pronounced extent locally, namely in the region where the tobacco or the cigarettes is/are subjected to mechanical loading. Up until now, said tobacco particles—together with dust and other particles—have been removed during cleaning of the machines.

The object of the invention is to improve the task of dealing with tobacco particles during the handling of tobacco or tobacco products in conjunction with production and packaging machines.

In order to achieve this object, the process according to the invention is characterized in that in regions of, in particular, increased accumulation of tobacco particles, on account of said tobacco particles being subjected to mechanical loading, the tobacco particles are intercepted and conveyed away and preferably centrally collected.

Accordingly, one subject of the invention concerns the specific intercepting, removal and collection of tobacco particles in the region where the latter occur to a pronounced extent. Furthermore, according to the invention, the tobacco particles are preferably centrally collected in the region of the relevant machine, or outside the same, and recycled to the production process for cigarettes or other tobacco products.

In packaging machines for cigarettes, the tobacco particles in the region of selected subassemblies—with increased accumulation of tobacco particles—are constantly removed and fed, in particular, to a tobacco separator, which separates the tobacco particles off from an air stream, by extraction by suction and/or by being conveyed away. The tobacco collected in the tobacco separator is removed from the latter and recycled into the production process of the cigarettes. The tobacco separator may be integrated in the packaging machine or installed outside the same as a separate subassembly and connected to the packaging machine via a central suction-extraction line.

Figures 5, 6, 7:
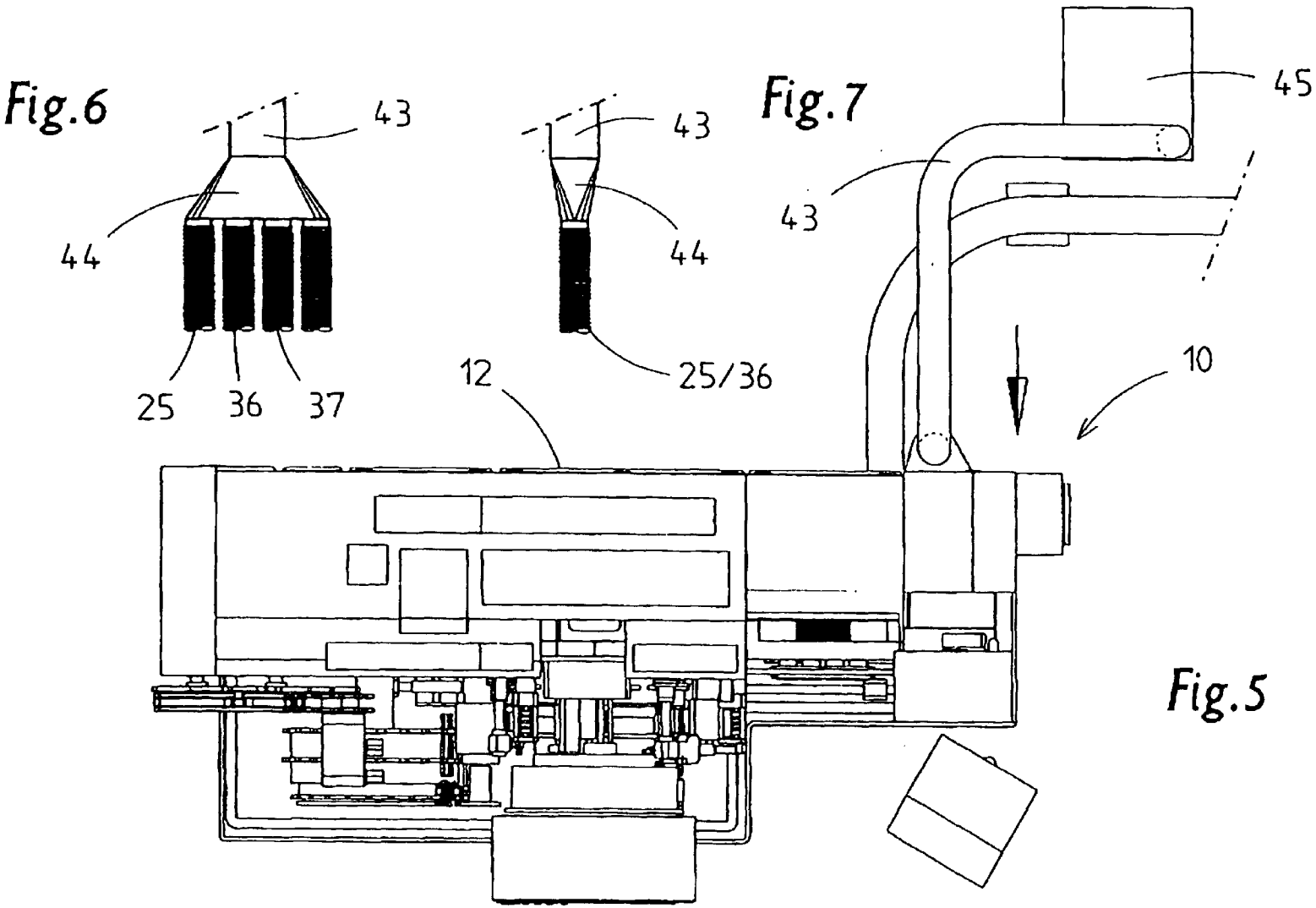
Figure 8:
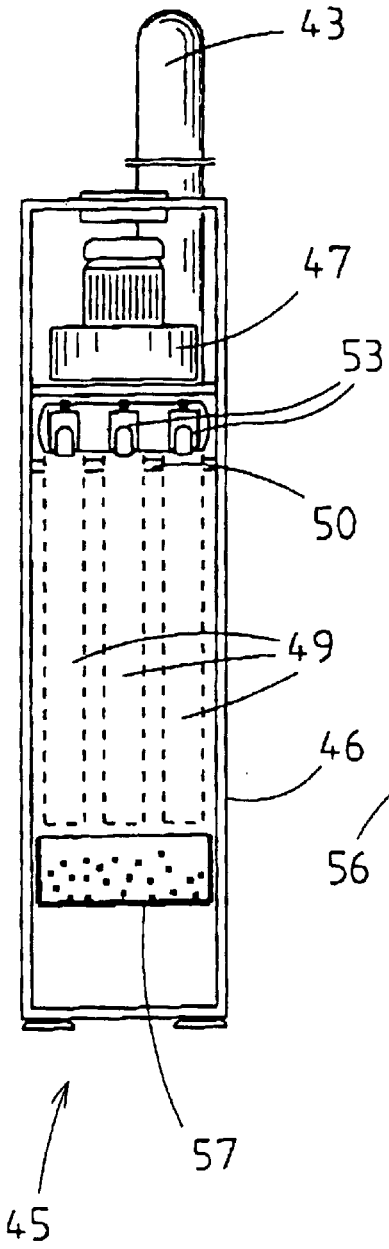
Figure 9:
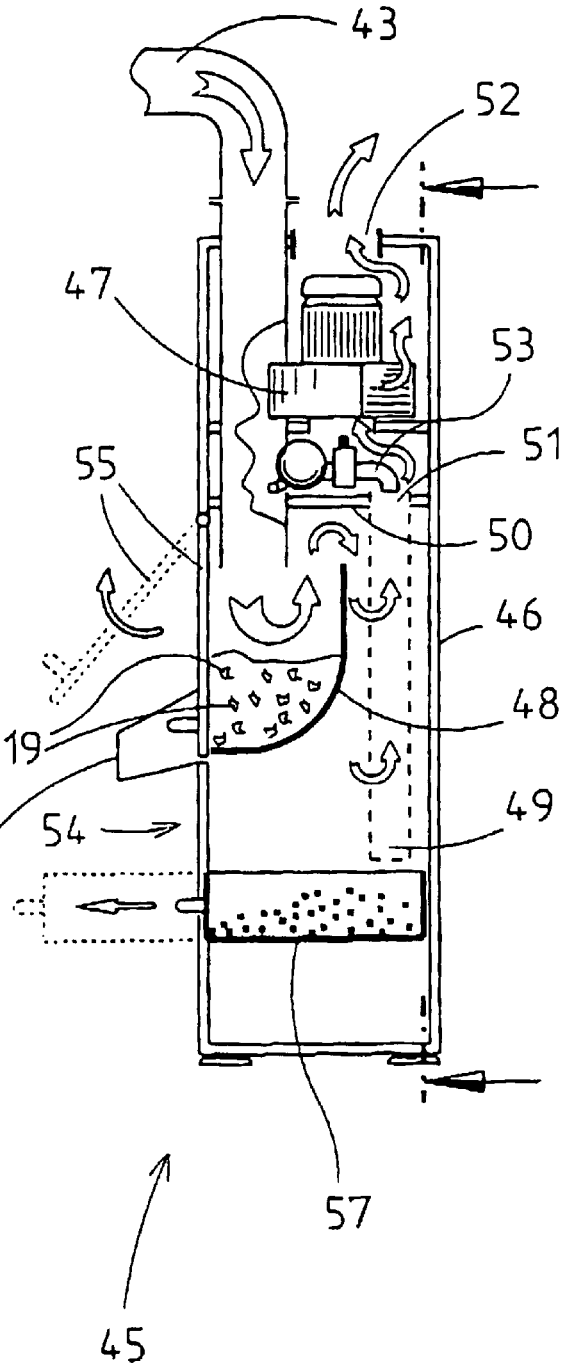

Further details of the invention deal with elements for conveying tobacco particles away, and extracting them by suction, from the region of machine subassemblies and to the configuration and arrangement of the tobacco separator. Exemplary embodiments of the invention are explained in more detail hereinbelow with reference to the drawings, in which:

FIG. 1 shows a subassembly of a (cigarette-)packaging machine, namely a cigarette magazine, in side view, FIG. 2 shows, on an enlarged scale, a detail of the subassembly according to FIG. 1, namely a region of a belt conveyor, FIG. 3 shows the cigarette magazine according to FIG. 1 in transverse view, FIG. 4 shows a further detail of the cigarette magazine in a view in accordance with arrow IV in FIG. 3, FIG. 5 shows a cigarette-packaging machine in plan view, FIG. 6 shows a view of a detail of the packaging machine, namely a suction-line collector, FIG. 7 shows the detail according to FIG. 6 in a view offset through 90°, FIG. 8 shows a tobacco separator in side view (from the inside), and FIG. 9 shows the tobacco separator in an illustration which is offset through 90° in relation to FIG. 8.

The overviews and details illustrated in the drawings are concerned with the preferred application example, namely the configuration and functioning of a packaging machine 10 for cigarettes 11. The packaging machine 10 (FIG. 5) may be a soft-pack packaging machine, that is to say a packaging machine 10 for producing soft packs. The packaging machine 10 is enclosed by a machine housing 12. Arranged within the same, and on the machine housing 12, are different subassemblies which are concerned with the handling of the cigarettes 11.

A packaging machine for cigarettes 11 contains a cigarette magazine 13 as standard. In the region of (four) shaft groups 14, cigarette groups 15 corresponding to the contents of a cigarette pack are removed from said cigarette magazine. Said cigarette groups are pushed into pockets 16 of a pocket chain 17. The cigarette groups 15 are transported by the pocket chain 17 in the region of a (horizontal) bottom strand 18.

There is an increased accumulation of tobacco residues or tobacco particles 19 in the region of the cigarette magazine 13 and of the adjoining conveyor for the cigarettes 11, namely the pocket chain 17. Said residues or particles are intercepted, and transported away, by specifically arranged and functionally configured conveying elements.

An intercepting hopper 20 is located beneath the pocket chain 17, in the region where the cigarette groups 15 are pushed into the pockets 16. The tobacco particles 19 which are freed by the cigarette groups 15 being pushed into the pockets 16 pass into said intercepting hopper. A hopper wall 21 is of arcuate or polygonal configuration and leads around a horizontal guide rod 22 which is positioned beneath the pocket conveyor 17 (FIG. 3).

A further receiving element for tobacco particles 19, namely a suction-extraction subassembly 23, follows the cigarette magazine 13 in the conveying direction of the pocket chain 17. By way of a suction-extraction housing 24, said suction-extraction subassembly encloses the pocket chain 17 on the top side and on a free longitudinal side. The suction-extraction housing 24 is adjoined—diagonally opposite the pocket chain 17—by a suction-extraction line 25. The latter is connected to a suction subassembly and extracts tobacco particles 19 from the suction-extraction housing 24 by suction.

Further elements for collecting and guiding tobacco particles 19 away are provided in the region of the cigarette magazine 13. FIG. 3 shows the cigarette magazine 13 in a side view and in a vertical section through a shaft group 14 or through an (upright) cigarette shaft in which the cigarettes are positioned in individual rows one above the other. The cigarette groups 15 are pushed out of the cigarette shafts or the shaft groups 14 by push rods 25. For this purpose, a group of push rods is pushed through the bottom region of the cigarette shafts or shaft groups 14 in the direction of the pocket chain 17. The cigarettes 11 are moved by the push rods 26 into the region of a pressing pocket 27 which can be moved up and down. In a top position of the pressing pocket 27, the cigarette group 15 is pushed into the same. Thereafter, the pressing pocket 27 is lowered—with the cigarette group 15 being compressed slightly at the same time. In the bottom position (FIG. 3), the (compressed)

cigarette group 15 is then pushed out of the pressing pocket, and into a pocket 16 of the pocket chain 17, by a pusher 28. In this case, the cigarette group 15 passes through a mouthpiece 29.

Tobacco particles 19 are inevitably released in the region of the pressing pocket 27 and/or of the mouthpiece 29. Said tobacco particles fall downwards alongside part of the packaging machine on account of their own weight.

A further region in which tobacco particles 19 are produced is the rear side of the cigarette magazine 13 in the operating region of the push rods 26. A rear magazine wall 30 is provided with a recess 31 in the bottom region. A further suction-extraction element 32 acts here. A suction member 33 is arranged above the movement plane of the push rods 26 (FIG. 4). Said suction member is an elongate body which extends along the rear side of the cigarette magazine 13 in the region of the recess 31. Suction chambers 34 are formed within the suction member 33. These are assigned to in each case one shaft group 14 of the cigarette magazine 13 and are open on the side directed towards the shaft group 14 (FIG. 3). The suction chambers 34 are connected to one another, with the result that the tobacco particles 19 can be extracted by suction from the region of the shaft groups 14 via said (four) suction chambers 34.

In the present exemplary embodiment, in each case two suction chambers 34 are connected to one another by a transverse channel 35. Both ends of the suction member 33 are adjoined by a suction-extraction line 36, 37. These, too, are connected to a negative-pressure source and, accordingly, extract the air with the tobacco particles by suction from the region described.

The pocket chain 17 or the bottom strand 18 thereof with the filled pockets 16 is provided over the entire conveying section with an intercepting element for tobacco particles 19. This is a conveying belt 38 beneath the bottom strand 18 of the pocket chain 17. The conveying belt receives tobacco particles 19 falling downwards under their own weight and conveys said tobacco particles—counter to the conveying direction of the pocket chain 17—to the intercepting hopper 20.

The tobacco particles received by the intercepting hopper 20 are led downwards and received beneath the intercepting hopper by a collecting element, namely a collecting belt 39. The latter is dimensioned in the transverse direction, namely widthwise, such that the tobacco particles falling downwards alongside the intercepting hopper 20, namely from the region of the pressing pocket 27, can also be received by said collecting belt 39.

The tobacco particles 19 received by the collecting belt 39 are transferred to a conveying-away element, namely to a suction tube 40. The latter is arranged at the end of the collecting belt 39, namely in the region of a deflecting roller 41. The suction tube 40 partially encloses the deflecting roller 41. The wall of the suction tube 40 is provided with an opening 42. The deflecting roller 41 is positioned in the region of the same, with the result that the collecting belt 39 with the tobacco particles runs into the suction tube 40. The latter extends in the axial direction of the deflecting roller 41. The suction tube 40 is connected to a negative-pressure source and conveys the tobacco particles as is illustrated in FIG. 3.

The tobacco particles extracted by suction or conveyed away in the region of the individual elements and subassemblies are expediently collected. In the present exemplary embodiment, the suction-extraction lines 25, 36, 37, which extend within the packaging machine 10 from the individual subassemblies, and suction-extraction tube 40 lead to a central, common suction tube, namely a main tube 43. The latter is provided with a hopper-like connecting member 44 which allows a plurality of suction lines or suction tubes to be connected to the central main tube 43.

The main tube 43, in turn, is connected to a tobacco separator 45. The latter may be arranged as a subassembly in the packaging machine 10, namely within the machine housing 12. In the present exemplary embodiment (FIG. 5), the main tube 43 leads to the tobacco separator 45 from the rear side of the packaging machine 10 or of the machine housing 12. Said tobacco separator is positioned, as a cabinet-like structure, at a distance from the packaging machine 10, on the rear side of the latter.

The tobacco separator 45 constitutes a further particular feature of the apparatus. The main tube 43 leads into a cabinet-like housing 46 from above. A fan 47 driven by an electric motor is positioned in the top region within said housing. The negative pressure is produced by said fan. For this purpose, air is conveyed downwards from the main tube 43. The suction air emerging from a bottom, open end of the main tube 43 is deflected by a separating element 48. This is a rounded wall which, together with a side wall of the housing 46, forms a container in which the tobacco particles 19 are collected by falling downwards. The air flows along the arrows, that is to say through the separating element 48 in the upward direction and then, alongside the separating element 48, through air filters 49 provided there. The latter are three filter cartridges which are located one beside the other and are of commercially available construction. The top end is connected to a transversely directed supporting wall 50 in the tobacco separator 45. The supporting wall 50 has through-passage openings 51 in the region of the air filters 49. The region above the supporting wall 50 is subjected to the action of negative pressure by the fan 47, with the result that the air is taken through the air filter 49 by suction. The air is cleaned in the air filters 49 and passes outwards through an outlet opening 52.

Compressed-air nozzles 53 are arranged above the supporting wall 50, in the region of the air filters 49. Said nozzles serve for cleaning the air filters 49 with the aid of compressed air and, from time to time, lead a compressed-air surge from a pressure tank through the air filters 49 in order to clean residues from the latter.

A special feature is that the intercepted and collected tobacco particles 19 can be recycled into the production process. The separating elements 48 can be emptied for this purpose. The container-like wall which forms the separating element 48 is arranged on an upright side wall 54 of the tobacco separator 45. Located in this region is a removal opening which is intended for the tobacco particles 19 and can be closed off by a flap 55 as part of the side wall 54. For the removal of the tobacco particles 19, the flap 55 is opened (dashed-line position in FIG. 9). The tobacco particles can then be removed, to be precise via a chute 56. The latter is positioned at a height which allows a vehicle or a movable receiving container to be positioned beneath the chute 56 for the purpose of receiving the tobacco particles 19.

A further intercepting element, namely a collecting container 57 which is open at the top, is arranged beneath the separating element 48 and also beneath the air filters 49 for the purpose of receiving any possible particles of dust. Said collecting container is designed as a drawer and can be drawn laterally out of the tobacco separator, namely via the side wall 54.

The abovedescribed elements and subassemblies for intercepting tobacco particles and conveying them away may also be arranged analogously in the case of other subassemblies and elements of the packaging machine, but in particular also correspondingly in the case of a maker.

| List of designations | |
|---|---|
| 10 | Packaging machine |
| 11 | Cigarette |
| 12 | Machine housing |
| 13 | Cigarette magazine |
| 14 | Shaft group |
| 15 | Cigarette group |
| 16 | Pocket |
| 17 | Pocket chain |
| 18 | Bottom strand |
| 19 | Tobacco particles |
| 20 | Intercepting hopper |
| 21 | Hopper wall |
| 22 | Guide rod |
| 23 | Suction-extraction subassembly |
| 24 | Suction-extraction housing |
| 25 | Suction-extraction line |
| 26 | Push rod |
| 27 | Pressing pocket |
| 28 | Pusher |
| 29 | Mouthpiece |
| 30 | Magazine wall |
| 31 | Recess |
| 32 | Suction-extraction element |
| 33 | Suction member |
| 34 | Suction chamber |
| 35 | Transverse channel |
| 36 | Suction-extraction line |
| 37 | Suction-extraction line |
| 38 | Conveying belt |
| 39 | Collecting belt |
| 40 | Suction tube |
| 41 | Deflecting roller |
| 42 | Opening |
| 43 | Main tube |
| 44 | Connecting member |
| 45 | Tobacco separator |
| 46 | Housing |
| 47 | Fan |
| 48 | Separating element |
| 49 | Air filter |
| 50 | Supporting wall |
| 51 | Through-passage opening |
| 52 | Outlet opening |
| 53 | Compressed-air nozzle |
| 54 | Side wall |
| 55 | Flap |
| 56 | Chute |
| 57 | Collecting container |

What is claimed is:

1. Apparatus for producing tobacco products with handling elements and subassemblies for handling the tobacco products, the apparatus comprising:

a plurality of receiving elements, at least one tobacco separator (45), and a chute, wherein the plurality of receiving elements include a first conveying element, a first suction-extraction element including suction lines, and at least one additional receiving element selected from the group consisting of: a second conveying element, a second suction-extraction element, and a collecting element, the plurality of receiving elements being arranged and positioned substantially adjacent to the handling elements and subassemblies for the purpose of receiving tobacco particles (19) caused to accumulate on account of the handling of the tobacco products by the handling elements and subassemblies, wherein at least one of the first and second conveying elements and the suction lines conveys the tobacco particles (19) away from the handling elements and subassemblies, wherein, at least one of the first and second conveying elements and the suction lines feeds the tobacco particles (19) to the at least one tobacco separator (45), which separates off, and collects, the tobacco particles (19), wherein the chute permits the removal of the tobacco particles (19) from the tobacco separator (45); and wherein at least one of the first suction-extraction element and the second suction-extraction element includes a suction based suction-extraction element (32) arranged and positioned substantially adjacent to a magazine (13) in a packaging machine (10) for the tobacco products, for forming groups (15) of the tobacco products, with the suction-based suction-extraction element (32) operating to extract the tobacco particles (19) by suction.

2. Apparatus according to claim 1, wherein the suction-based suction-extraction element (32) is arranged and positioned in a predetermined rear location of the magazine (13) for holding the tobacco products disposed directly above a movement plane of push rods (26) for pushing the groups (15) of tobacco products out of the magazine (13).

3. Apparatus according to claim 2, wherein:

each of the tobacco products includes a filter at an end thereof; and the suction-based suction-extraction element (32) has a suction element (33) which is directed towards the filter ends of the tobacco products, and the suction member (33) extends transversely over the entire width of the magazine (13) and has suction chambers (34) for receiving suction air with tobacco particles (19), the suction chambers (34) being open at least partially on the side directed towards the tobacco products in the magazine (13).

4. Apparatus according to claim 3, wherein two suction-extraction lines (36, 37) arranged at mutually opposite ends are connected to at least one of the suction member (33) and to the suction chambers (34) for the purpose of extracting air with tobacco particles (19) by suction.

5. Apparatus according to claim 1, further comprising:

a main tube (43) having a connecting member therein, wherein the tobacco separator (45) is connected to the connecting member (44) in the main tube (43), for receiving the tobacco particles (19) from a packaging machine and/or of a maker by individual suction-extraction lines thereof which run within the packaging machine and/or within the maker opening out, via the connecting member (44), in the main tube (43), which leads to the tobacco separator (45).

6. Apparatus for producing tobacco products with handling elements and subassemblies for handling the tobacco products, the apparatus comprising:

a plurality of receiving elements, at least one tobacco separator (45), a chute, a pocket chain (17) with pockets (16) for receiving in each pocket a group (15) of tobacco products, and a pusher for pushing the tobacco products into the pockets (16), wherein the plurality of receiving elements includes a first conveying element, a first suction-extraction element including suction lines, and at least one additional receiving element selected from the group consisting of: a second conveying element, a second suction-extraction element, and a collecting element, the plurality of receiving elements being arranged and positioned substantially adjacent to the handling elements and subassemblies for the purpose of receiving tobacco particles (19) caused to accumulate on account of the handling of the tobacco products by the handling elements and subassemblies, wherein at least one of the first and second conveying elements and the suction lines conveys the tobacco particles (19) away from the handling elements and subassemblies, wherein at least one of the first and second conveying elements and the suction lines feeds the tobacco particles (19) to the at least one tobacco separator (45), which separates off, and collects, the tobacco particles (19), wherein the chute permits the removal of the tobacco particles (19) from the tobacco separator (45); and wherein at least one suction-extraction subassembly (23) is positioned substantially adjacent to the pusher where the groups (15) of tobacco products are pushed into the pockets (16) of the pocket chain (17).

7. Apparatus according to claim 6, wherein the at least one suction-extraction subassembly (23) has a suction-extraction housing (24) which partially encloses the pocket chain (17) at a top side and a longitudinal side of the pocket chain (17) with a suction-extraction line (25) adjoining the suction-extraction housing (24).

8. Apparatus for producing tobacco products with handling elements and subassemblies for handling the tobacco products, the apparatus comprising:

a plurality of receiving elements, at least one tobacco separator (45), a chute, and a suction-extraction subassembly, wherein the plurality of receiving elements include a first conveying element, a first suction-extraction element including suction lines, and at least one additional receiving element selected from the group consisting of: a second conveying element, a second suction-extraction element, and a collecting element, the plurality of receiving elements being arranged and positioned substantially adjacent to the handling elements and subassemblies for the purpose of receiving tobacco particles (19) caused to accumulate on account of the handling of the tobacco products by the handling elements and subassemblies, wherein at least one of the first and second conveying elements includes conveying belts (38, 39), and at least one of the first and second conveying elements and the suction lines conveys the tobacco particles (19) away from the handling elements and subassemblies, wherein at least one of the first and second conveying elements and the suction lines feeds the tobacco particle (19) to the at least one tobacco separator (45), which separates off, and collects, the tobacco particles (19), wherein the chute permits the removal of the tobacco particles (19) from the tobacco separator (45);

wherein the conveying belts (38, 39) intercept and transport away tobacco particles (19) falling downward under their own weight with the conveying belts (38, 39) for feeding the suction-extraction subassembly for the purpose of the tobacco particles being transported further by means of suction air.

9. Apparatus according to claim 8, further comprising:

a first collecting element having an intercepting hopper;

wherein the conveying belts (38, 39) include a first conveying belt (38) which extends in the longitudinal direction of a conveying path of the first and second conveying elements with the first conveying belt (38) feeding tobacco particles (19) intercepted by the first conveying belt (38) to the first collecting element.

10. Apparatus according to claim 9, wherein the conveying belts (38, 39) include a second conveying belt (39) arranged and positioned beneath the intercepting hopper (20) for intercepting and directing the tobacco particles falling downwards under their own weight to be increasingly accumulated in the intercepting hopper (20).

11. Apparatus for producing tobacco products with handling elements and subassemblies for handling the tobacco products, the apparatus comprising:

a plurality of receiving elements, at least one tobacco separator (45), a chute, a collecting belt (39) having a deflecting roller, and a suction-extraction subassembly having a suction tube (40), wherein the plurality of receiving elements include a first conveying element, a first suction-extraction element including suction lines, and at least one additional receiving element selected from the group consisting of: a second conveying element, a second suction-extraction element, and a collecting element, the plurality of receiving elements being arranged and positioned substantially adjacent to the handling elements and subassemblies for the purpose of receiving tobacco particles (19) caused to accumulate on account of the handling of the tobacco products, by the handling elements and subassemblies, wherein at least one of the first and second conveying elements and the suction lines conveys the tobacco particles (19) away from the handling elements and subassemblies, wherein at least one of the first and second conveying elements and the suction lines feeds the tobacco particles (19) to the at least one tobacco separator (45), which separates off, and collects, the tobacco particles (19), wherein the chute permits the removal of the tobacco particles (19) from the tobacco separator (45); and wherein the collecting belt (39) transports and feeds the tobacco particles (19) to the suction-extraction subassembly having the suction tube (40) with the suction-extraction subassembly arranged and positioned substantially adjacent to the deflecting roller (41) of the collecting belt (39) and partially enclosed by the deflecting roller (41) such that the collecting belt (39) conveys the tobacco particles into a suction tube (40).

12. Apparatus for producing tobacco products with handling elements and subassemblies for handling the tobacco products, the apparatus comprising:

a plurality of receiving elements, at least one tobacco separator (45), and a chute, wherein the plurality of receiving elements include a first conveying element, a first suction-extraction element including suction lines, and at least one additional receiving element selected from the group consisting of: a second conveying element, a second conveying element, a second suction-extraction element, and a collecting element, the plurality of receiving elements being arranged and positioned substantially adjacent to the handling elements and subassemblies for the purpose of receiving tobacco particles (19) caused to accumulate on account of the handling of the tobacco products by the handling elements and subassemblies, wherein at least one of the first and second conveying elements and the suction lines conveys the tobacco particles (19) away from the handling elements and subassemblies, wherein at least one of the first and second conveying elements and the suction lines feeds the tobacco particles (19) to the at least one tobacco separator (45), which separates off, and collects, the tobacco particles (19), wherein the chute permits the removal of the tobacco particles (19) from the tobacco separator (45); and wherein the tobacco separator (45) is positioned exterior to a packing machine (10), at a distance from the packaging machine (10), with a main tube (43) leading out of the packaging machine (10) to the tobacco separator (45).

13. Apparatus according to claim 12, wherein the tobacco separator (45) includes a housing (46) having an outlet opening (52), wherein the main tube (43) passes into the housing (46) of the tobacco separator (45), such that, within the housing (46), the tobacco separator (45) separates off the air from the tobacco particles (19) and directs the air to emerge from the housing (46) via the outlet opening (52).

14. Apparatus for producing tobacco products with handling elements and subassemblies for handling the tobacco products, the apparatus comprising:

a plurality of receiving elements, and a chute, at least one tobacco separator (45) having:

a housing (46), a fan (47) disposed within the housing (46), and a separating element, wherein the plurality of receiving elements include a first conveying element, a first suction-extraction element including suction lines, and at least one additional receiving element selected from the group consisting of: a second conveying element, a second suction-extraction element, and a collecting element, the plurality of receiving elements being arranged and positioned substantially adjacent to the handling elements and subassemblies for the purpose of receiving tobacco particles (19) caused to accumulate on account of the handling of the tobacco products by the handling elements and subassemblies, wherein a least one of the first and second conveying elements and the suction lines conveys the tobacco particles (19) away from the handling elements and subassemblies, wherein at least one of the first and second conveying elements and the suction lines feeds the tobacco particles (19) to the at least one tobacco separator (45), which separates off, and collects, the tobacco particles (19), wherein the chute permits the removal of the tobacco particles (19) from the tobacco separator (45); and wherein the fan (47) produces suction air, allowing taken-in-air, which is mixed with tobacco particles (19), to be fed to the separating element (48) for separating off the tobacco particles (19), and for leading the air freed from the tobacco particles (19) outwards by the fan (47).

15. Apparatus according to claim 14, wherein the tobacco separator (45) separates off the tobacco particles (19) substantially adjacent to the separating element (48), and leads the taken-in air through cleaning elements having air filters (49).

16. Apparatus for producing tobacco products with handling elements and subassemblies for handling the tobacco products, the apparatus comprising:

a plurality of receiving elements, a chute, and at least one tobacco separator (45) having:

a separating element (48), and a removal assembly for collected particles (19), with the removal assembly including:

a base; and a flap (55) which is positioned at a distance from the base, wherein the plurality of receiving elements include a first conveying element, a first suction-extraction element including suction lines, and at least one additional receiving element selected from the group consisting of: a second conveying element, a second suction-extraction element, and a collecting element, the plurality of receiving elements being arranged and positioned substantially adjacent to the handling elements and subassemblies for the purpose of receiving the tobacco particles (19) caused to accumulate on account of the handling of the tobacco products, by the handling elements and subassemblies, wherein at least one of the first and second conveying elements and the suction lines conveys the tobacco particles (19) away from the handling elements and subassemblies, wherein at least one of the first and second conveying elements and the suction lines feeds the tobacco particles (19) to the at least one tobacco separator (45), which separates off, and collects, the tobacco particles (19), wherein the chute permits the removal of the tobacco particles (19) from the tobacco separator (45); and wherein the removal assembly is arranged and positioned substantially adjacent to the separating element (48).

* * * * *